US008136255B1

(12) United States Patent
Reel

(10) Patent No.: US 8,136,255 B1
(45) Date of Patent: Mar. 20, 2012

(54) BROADLOOM CARPET WALL TRIMMER AND METHOD OF USE THEREOF

(76) Inventor: Terry A. Reel, Sapula, OK (US)

( * ) Notice: Subject to any disclaimer, the term of this patent is extended or adjusted under 35 U.S.C. 154(b) by 454 days.

(21) Appl. No.: 12/154,350

(22) Filed: May 22, 2008

(51) Int. Cl.
*B26B 29/06* (2006.01)

(52) U.S. Cl. ..... 30/287; 30/294

(58) Field of Classification Search ..... 30/294, 30/287, 286, 488
See application file for complete search history.

(56) References Cited

U.S. PATENT DOCUMENTS

| | | | | |
|---|---|---|---|---|
| 3,382,579 | A | 5/1968 | Prater | |
| 3,395,453 | A * | 8/1968 | Prater | 30/293 |
| 3,546,726 | A * | 12/1970 | Bizzigotti | 7/103 |
| 4,095,341 | A * | 6/1978 | Crain | 30/287 |
| 4,262,418 | A * | 4/1981 | Hill et al. | 30/287 |
| 5,044,081 | A | 9/1991 | Nguyen | |
| 5,881,463 | A | 3/1999 | Casteel et al. | |
| 5,984,392 | A | 11/1999 | Iannacone, Jr. | |
| 6,230,410 | B1 | 5/2001 | Taylor et al. | |
| 6,421,923 | B1 | 7/2002 | Nguyen | |
| 6,938,292 | B1 | 9/2005 | Iannacone, Jr. | |
| 6,964,075 | B1 | 11/2005 | Iannacone, Jr. | |

OTHER PUBLICATIONS

Magrab, Edward B. Integrated Product and Process Design and Development. (IPPDD). CRC Press, Boca Raton. © 1997. p. 145.*

* cited by examiner

*Primary Examiner* — Sean Michalski
(74) *Attorney, Agent, or Firm* — Montgomery Patent & Design, LLC; Robert C. Montgomery; Joseph T. Yaksich

(57) ABSTRACT

A broadloom trimming device to trim carpeting along baseboards includes a base, a tucker, a vertical baseboard plate which has two plastic rollers that glide easily without damaging the baseboards. The device employs an adjustment mechanism allowing a height adjustment plate bearing a cutting mechanism to be raised or lowered easily using integral springs and a thumbnut. The device further includes a handle seated between arms of the adjustment plate.

12 Claims, 3 Drawing Sheets

BROADLOOM CARPET WALL TRIMMER AND METHOD OF USE THEREOF

RELATED APPLICATIONS

The present invention was first described in and claims the benefit of Disclosure Document No. 609,160 filed on Nov. 16, 2006, the entire disclosures of which are incorporated herein by reference.

FIELD OF THE INVENTION

The present invention relates generally to an adjustable carpet trimming device for cutting excess carpet portions along an existing baseboard during carpet installation procedures.

BACKGROUND OF THE INVENTION

The home center and hardware store industry includes about thirty thousand (30,000) stores with combined annual revenue of about two hundred billion dollars ($200,000,000,000). Home remodeling and repair and new homebuilding drive the demand for home improvement products.

As anyone who performs a lot of home improvement work will attest, nothing beats having the proper tool for a job. The proper tool can save time and money, in addition to producing a higher quality job, reducing damage to equipment and providing for the increased safety of the worker. Each area of expertise has its own type of specialty tools, each performing a dedicated task. The field of carpet installation is no exception. When broadloom wall-to-wall carpet is installed, it must be cut along the wall or baseboard edge. However, the conventional tool commonly used to perform this task has several disadvantages. First, the sliding guide that runs along the wall or baseboard during the cutting process is prone to leave black marks on the surface or perhaps even cause severe damage. Second, the tool must be adjusted for carpets of varying heights by removing or adding shims. This very time-consuming process only allows for minor adjustments and exposes the separate shims to possible loss over time. Accordingly, there is a need for a means by which carpet can be trimmed along wall and/or baseboard surfaces without the disadvantages outlined above. The development of the present invention fulfills this need.

U.S. Pat. No. 6,964,075 filed by Iannacone discloses a carpet trimmer and tucker. This patent does not appear to disclose a carpet wall trimmer that possesses wheels to assist the device in moving along a baseboard as it cuts and tucks the carpet.

U.S. Pat. No. 6,938,292 filed Iannacone discloses a carpet trimmer and tucker. This patent does not appear to disclose a carpet wall trimmer that possesses wheels to assist the device in moving along a baseboard as it cuts and tucks the carpet.

U.S. Pat. No. 6,421,923 filed by Nguyen disclose a carpet trimmer. This patent does not appear to disclose a device that that possesses wheels to assist the device in moving along a baseboard as it cuts and tucks the carpet.

U.S. Pat. No. 6,230,410 filed by Taylor and Anderson discloses a wall trimmer for carpet and vinyl floor coverings. This patent does not appear to disclose a device that possesses wheels to assist the device in moving along a baseboard as it cuts and tucks the carpet nor does the patent appear to disclose an ergonomic handle.

U.S. Pat. No. 5,984,392 filed by Iannacone discloses a carpet tucking apparatus. This patent does not appear to disclose a carpet trimmer device that glides on wheels along the baseboard.

U.S. Pat. No. 5,881,463 filed by Casteel and Wenzel discloses a carpet face cutter with coacting surfaces and cutouts for securing the lowermost corner of each cutter blade against deflection. This patent does not appear to disclose a device that is useful for trimming broadloom carpet at wall edges nor does it appear to disclose a trimmer that uses wheels to move along the baseboard without causing baseboard damage.

U.S. Pat. No. 5,044,081 filed by Nguyen discloses a carpet trimmer with a recessed guide. This patent does not appear to disclose a device that is useful for trimming broadloom carpet at wall edges nor does it appear to disclose a trimmer that uses wheels to move along the baseboard without causing baseboard damage.

U.S. Pat. No. 4,095,341 filed by Crain discloses a carpet trimmer. This patent does not appear to disclose a device that possesses wheels to assist the device in moving along a baseboard as it cuts and tucks the carpet nor does the patent appear to disclose an ergonomic handle.

U.S. Pat. No. 3,382,579 filed by discloses a folddown handle for carpet trimmers. This patent does not appear to disclose a device that that possesses wheels to assist the device in moving along a baseboard as it cuts and tucks the carpet.

The prior art appears to disclose various devices that cut and tuck carpeting along baseboards. The prior art does not appear to disclose a broadloom carpet wall trimmer that possesses wheels upon the side of the trimmer that contacts the baseboard to prevent damage to the baseboard while the device is in use.

SUMMARY OF THE INVENTION

In view of the foregoing disadvantages inherent in the prior art, it has been observed that there is need for an improved broadloom carpet wall trimmer that can be used without causing damage to baseboards.

An aspect of the present invention provides for the improved broadloom carpet wall trimmer provides a means for a broadloom carpet trimming device to trim excess wall-to-wall carpeting along baseboards.

Another aspect of the present invention provides for several enhancements from traditional trimmers and provides a better appearance without damage to walls or baseboards.

Another aspect of the present invention provides for two (2) plastic rollers that glide easily without damaging or marking the baseboards.

Another aspect of the present invention provides for the improved broadloom carpet wall trimmer to be adjusted for carpet thickness using a height adjustment mechanism.

Another aspect of the present invention provides for the improved broadloom carpet wall trimmer to further comprise a base, a height adjustment plate, a baseboard plate, and a handle.

Yet another aspect of the present invention provides for the base to comprise a flat metal quadrangle shape having a wide forward edge of approximately seven (7) to ten (10) inches wide. The base provides a user with a smoothly sliding surface while maintaining the device in a horizontal plane along a surface of a carpet during use. The base is envisioned to be made using a plastic faced aluminum plate to minimize friction and provide a smooth sliding motion while being manipulated across said carpet surface. The base provides an attachment means to the height adjustment plate along a top rear edge via a pair of pivot brackets being affixed to said base using a plurality of pivot bracket fasteners.

Yet another aspect of the present invention provides for the height adjustment plate to further comprise a pivot bolt, a pivot nut, a first height adjustment arm, a second height adjustment arm, a pair of guidepost apertures, a pair of blade retaining studs, and a pair of blade retaining nuts. The height adjustment plate provides an adjustable positioning means thereto a pair of cutting blades located at right and left outer edges of the device, thereby facilitating carpet trimming in a bi-directional manner. The cutting blades may be vertically adjusted to correspond thereto carpets of differing thicknesses via the height adjustment plate comprising a first height adjustment arm and a second height adjustment arm. The first and second height adjustment arms are integral to the height adjustment plate extending in a rearward direction being hingedly attached to the pivot brackets via a horizontal pivot bolt and pivot nut. The pivot bolt and pivot nut provide secure axle-like function passing through the pivot brackets, the first height adjustment arm, and the second height adjustment arm, in an expected manner. The first and second adjustment arms extend forward thereto the height adjustment plate forming a single piece "U"-shaped horizontal plate.

Yet another aspect of the present invention provides for the height adjustment plate to further comprise a forward edge being parallel and adjacent thereto a front edge of the aforementioned base. The height adjustment plate provides an attachment means along said front edge to the baseboard plate being that is affixed in a perpendicular manner.

Yet another aspect of the present invention provides for the baseboard plate to further comprise an ovular vertical surface envisioned to be affixed thereto the height adjustment plate preferably using a welding process; however, the baseboard plate may be integral to said height adjustment plate or affixed to using screws, rivets, or the like. The height adjustment plate and the baseboard plate comprise a vertically adjustable assembly providing a vertically adjustable means thereto a pair of cutting blades. The cutting blades are affixed thereto a top surface of the height adjustment plate along a forward edge using a pair of integral blade retaining studs and blade retaining nuts. The cutting blades are envisioned to comprise standard trapezoidal refill blades common in the industry.

Still yet another aspect of the present invention provides expected blade securing features such as recessed areas, cutouts, retaining plates, and the like to properly position and expose the cutting blade edges. The height adjustment plate further comprises a first guidepost, a second guidepost, a pair of compression springs, an adjuster bolt, and a thumbnut. The height adjustment plate is held firmly at a user selectable height by a spring force applied to a bottom surface by the compression springs which press and hold said plate up against the thumbnut being threadingly attached to a centrally located adjuster bolt being threadingly affixed to the base. The thumbnut is a common two (2) or three (3) ear plastic fastener that provides easy manual adjustment.

Still yet another aspect of the present invention provides for the compression springs to align and circumscribe around a first guidepost and a second guidepost which provide additional lateral stability thereto the height adjustment plate during use. The guideposts comprise custom flat-head fasteners being threadingly affixed to the base along a bottom surface thereof and comprising straight sides which extend upwardly therethrough said compression springs and continue upwardly being slidingly inserted through the height adjustment plate via a pair of guidepost apertures. The guidepost apertures are located at outer positions along a rear edge of said height adjustment plate and comprise drilled holes specifically sized so as to fit snuggly over the guideposts.

Yet another aspect of the present invention provides for a pair of rollers, a pair of axles, and a pair of roller apertures. The baseboard plate comprises an elongated oval shaped plate approximately six (6) to eight (8) inches wide and one-eighth (%) inch thick, extending horizontally, parallel to, and slightly forward thereof, the front edge of the base. The baseboard plate provides a positioning means thereto a pair of vertical plastic rollers being affixed to said baseboard plate at opposing leading and trailing ends by fixed vertical axles. The rollers provide a smooth lateral motion of the device when pressed against a baseboard while coincidentally maintaining a constant distance from said baseboard during a carpet trimming task.

Still yet another aspect of the present invention provides for the rollers to be made of a durable plastic material such as nylon, urethane, or the like being approximately three-eighths (3/8) inch in diameter and one-half (1/2) inch in height. The rollers are mounted in line therewith and internal thereto the baseboard plate via a pair of rectangular roller apertures. The roller apertures enable a small portion of said rollers to protrude beyond a forward surface of the baseboard plate. The roller axles are envisioned to comprise steel pins approximately one-sixteenth (1/16) to one-eighth (1/4) inch in diameter being preferably press-fitted therein vertically drilled holes along upper and lower surfaces of the baseboard plate and positioned centrally within the roller apertures; however, the roller axles may be attached to the baseboard plate using threaded portions.

Yet another aspect of the present invention provides an ergonomic grasping appendage comprising a looping shape having a generally round cross-section approximately one-and-a-half (1½) inches in diameter. The handle provides an attachment to the base by a plurality of handle fasteners. The handle is envisioned to protrude upward from the base approximately two (2) inches before angling towards a rear portion of the device at approximately twenty degrees (20°) from a vertical plane. The handle allows a user to exert a steady downward and forward force during use. The handle is envisioned to be made using sturdy materials such as aluminum, wood, plastic, or the like and may be provided with a compliant high-friction coating of rubber or plastic to improve a user's grip and reduce skin fatigue during periods of extended use of the device. Other ergonomically sound designs of the handle may be utilized based upon a user's preference.

The device further comprises: a base, a plurality of pivot bracket fasteners, a pair of handle fasteners, an adjuster bolt, a first guidepost, a second guidepost, a sliding surface, and a tucker. The base provides a flat bottom surface thereto the device as it slides along a carpet surface. The base comprises a number of fasteners and attachment components providing an attachment means to top mounted elements. The fasteners and attachment hardware comprise flat-head designs so as to maintain a flat bottom surface. The adjuster bolt, the first and second guideposts comprise an attachment means to the base by a male threaded length threadingly engaged to mating female threaded portions in the base. The pivot bracket fasteners and handle fasteners utilize a plurality of drill holes through said base. The base further comprises an integral tucker appendage located at an intermediate position along a front edge. The tucker appendage protrudes outward and slightly downward therefrom the base approximately one (1) inch. The tucker appendage provides a directional and downward force to a trimmed carpet edge, thereby automatically performing an additional task by propelling said carpet edge under a lower edge of a baseboard during use.

The base further comprises a sliding surface affixed upon an entire bottom surface. The sliding surface is attached to the base using a variety of adhesives, epoxies, or the like in an expected manner. The sliding surface is further envisioned to comprise a low-friction material such as Teflon®, fiberglass, nylon, high-durometer urethane, or the like which permits the device to slide smoothly across a carpet during trimming.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | improved broadloom carpet wall trimmer |
| 20 | base |
| 21 | first guidepost |
| 22 | compression spring |
| 23 | adjuster bolt |
| 24 | adjuster nut |
| 25 | second guidepost |
| 26 | pivot bracket |
| 27 | pivot bracket fastener |
| 28 | sliding surface |
| 29 | tucker |
| 30 | height adjustment plate |
| 31 | first height adjustment arm |
| 32 | second height adjustment arm |
| 33 | pivot nut |
| 34 | blade retaining stud |
| 35 | blade retaining nut |
| 36 | pivot bolt |
| 37 | guidepost aperture |
| 40 | baseboard plate |
| 41 | roller |
| 42 | roller axle |
| 43 | roller aperture |
| 50 | handle |
| 51 | handle fastener |
| 100 | cutting blade |

DETAILED DESCRIPTION OF THE PREFERRED EMBODIMENT

Figure 1:
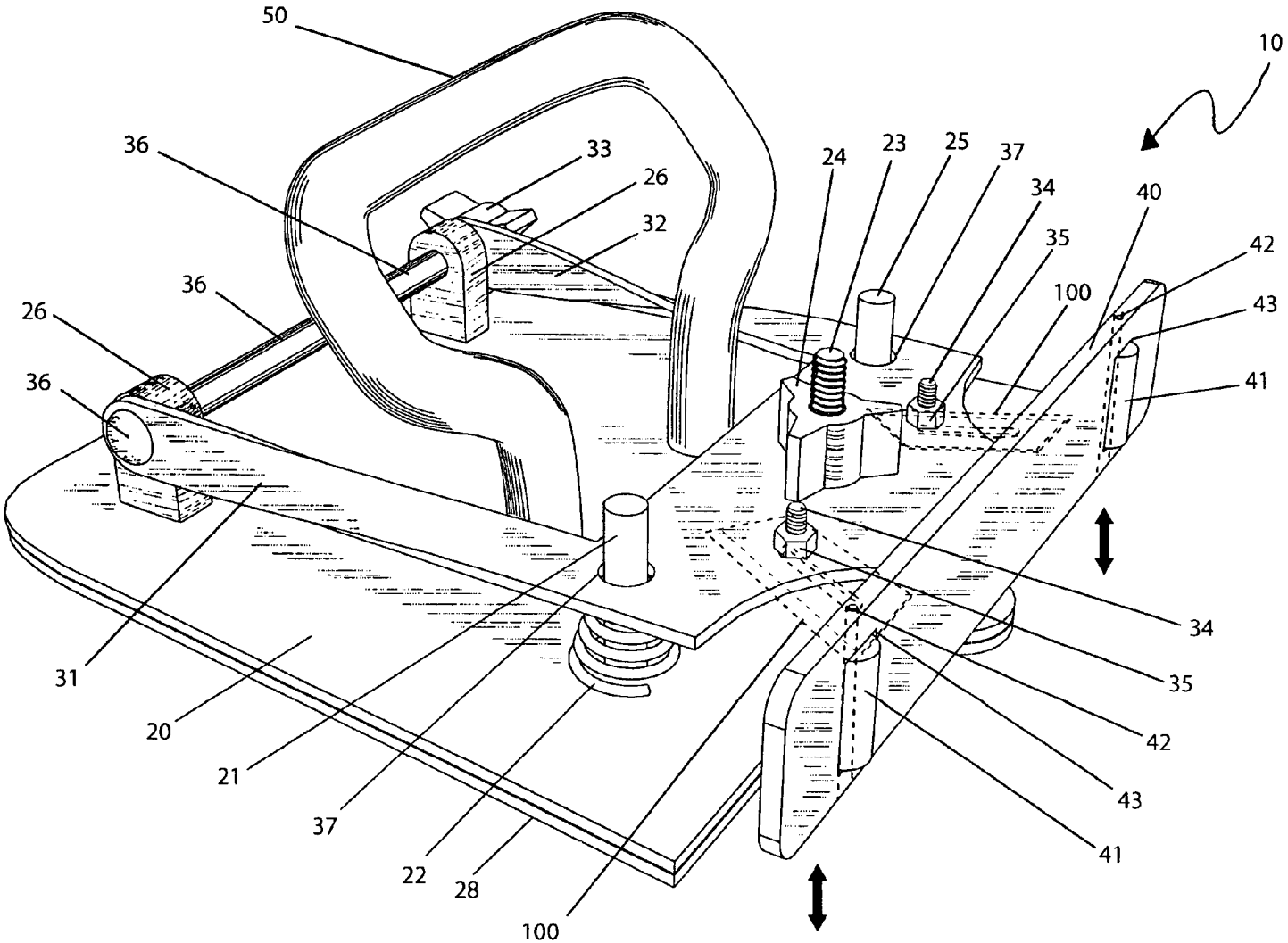
FIG. 1 is a side perspective view of an improved broadloom carpet wall trimmer 10, according to a preferred embodiment of the present invention.
Figure 2:
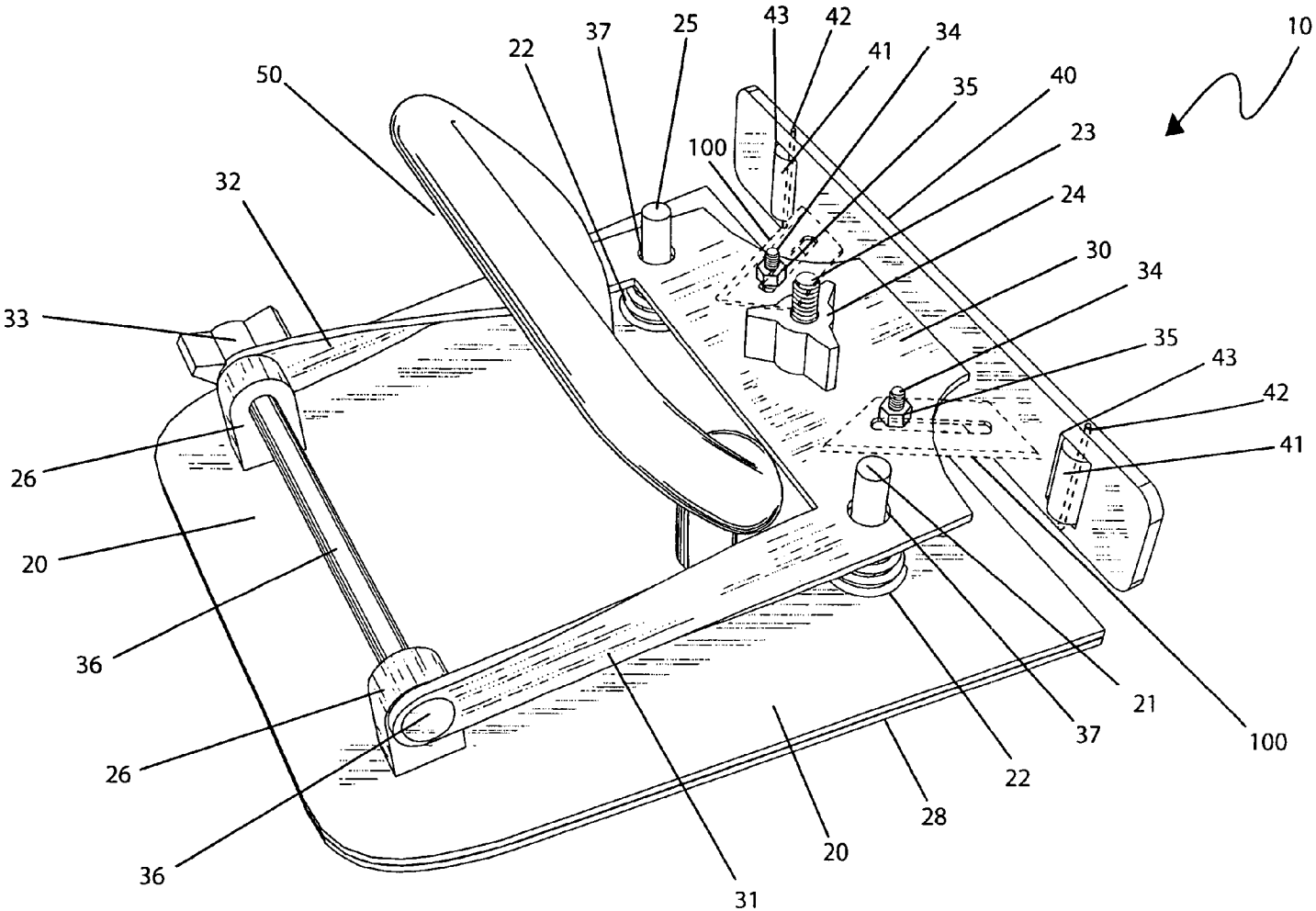
FIG. 2 is a rear perspective view of an improved broadloom carpet wall trimmer 10, according to a preferred embodiment of the present invention; and, FIG. 3 is a bottom perspective view of an improved broadloom carpet wall trimmer 10, according to a preferred embodiment of the present invention.
Figure 3:
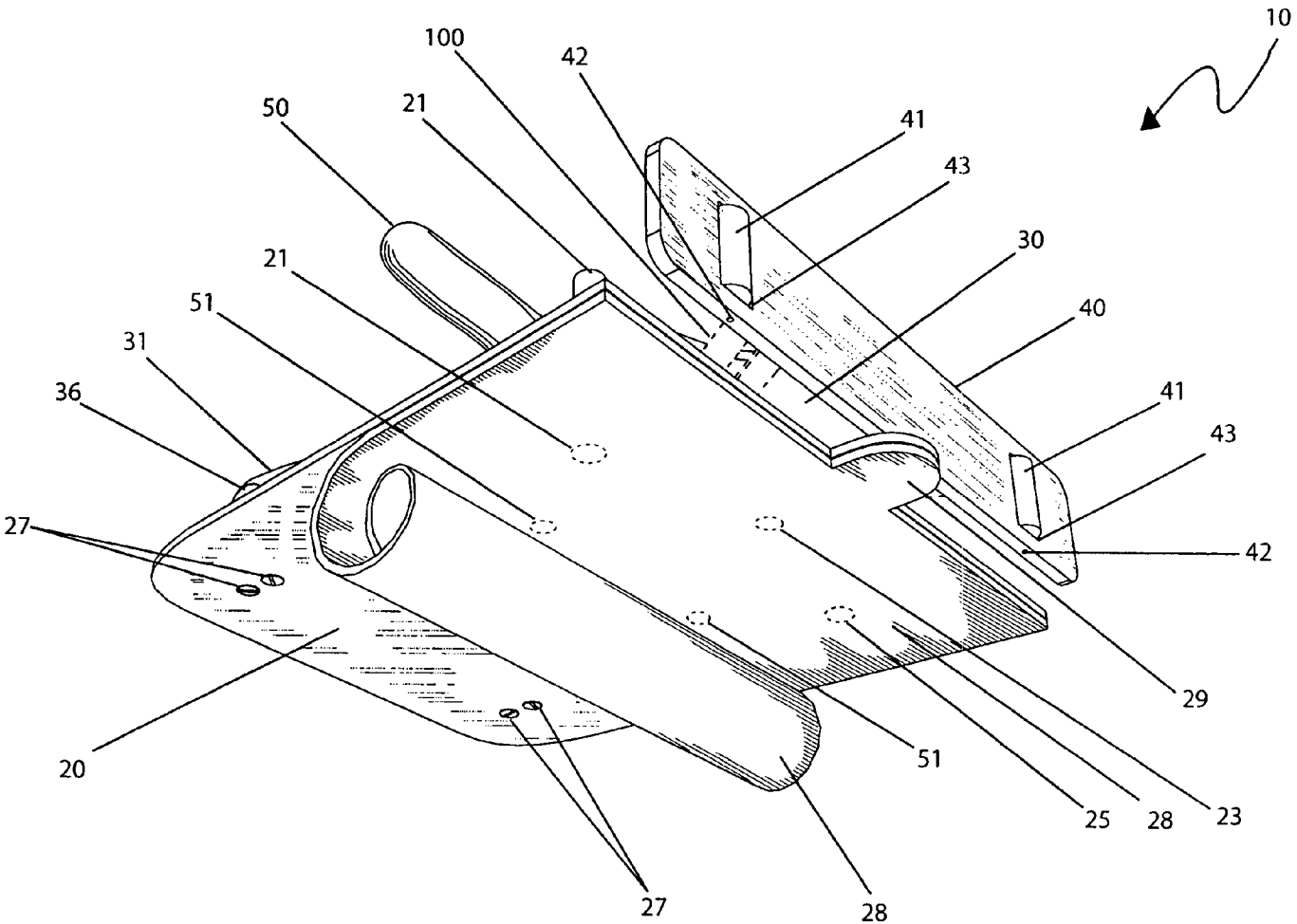

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a improved broadloom carpet wall trimmer (herein described as the "device") 10, which provides a means for a broadloom carpet trimming device 10 to trim excess wall-to-wall carpeting along baseboards. The device 10 has several enhancements from traditional trimmers which provide a better appearance without damage to walls or baseboards. In place of a metal guide 40 which contacts a baseboard with conventional devices, the current device 10 has two plastic rollers 41 that glide easily without damaging or marking the baseboards. To adjust for carpet thickness, the device 10 employs a height adjustment mechanism 30 allowing it to be raised or lowered easily using a thumbnut 24.

Referring now to FIGS. 1 and 2, a side perspective and rear perspective view of the device 10, according to the preferred embodiment of the present invention, are disclosed. The device 10 comprises a base 20, a height adjustment plate 30, a baseboard plate 40, and a handle 50. The base 20 comprises a flat metal quadrangle shape having a wide forward edge of approximately seven (7) to ten (10) inches wide. The base 20 provides a user with a smoothly sliding surface while maintaining the device 10 in a horizontal plane along a surface of a carpet during use. The base 20 is envisioned to be made using a plastic faced aluminum plate to minimize friction and provide a smooth sliding motion while being manipulated across said carpet surface. The base 20 provides an attachment means to the height adjustment plate 30 along a top rear edge via a pair of pivot brackets 26 being affixed thereto said base 20 using a plurality of pivot bracket fasteners 27. The height adjustment plate 30 further comprises a pivot bolt 36, a pivot nut 33, a first height adjustment arm 31, a second height adjustment arm 32, a pair of guidepost apertures 37, a pair of blade retaining studs 34, and a pair of blade retaining nuts 35. The height adjustment plate 30 provides an adjustable positioning means thereto a pair of cutting blades 100 located at right and left outer edges of the device 10, thereby facilitating carpet trimming in a bi-directional manner. The cutting blades 100 may be vertically adjusted to correspond thereto carpets of differing thicknesses via the height adjustment plate 30 further comprising a first height adjustment arm 31 and a second height adjustment arm 32. The first 31 and second 32 height adjustment arms are integral thereto the height adjustment plate 30 extending in a rearward direction being hingedly attached thereto the pivot brackets 26 via a horizontal pivot bolt 36 and pivot nut 33. The pivot bolt 36 and pivot nut 33 provide secure axle-like function passing therethrough the pivot brackets 26, the first height adjustment arm 31, and the second height adjustment arm 32, in an expected manner. Said first 31 and second 32 adjustment arms extend forward thereto the height adjustment plate 30 forming a single piece "U"-shaped horizontal plate. Said height adjustment plate 30 comprises a forward edge being parallel and adjacent thereto a front edge of the aforementioned base 20. The height adjustment plate 30 provides an attachment means along said front edge thereto the baseboard plate 40 being affixed in a perpendicular manner thereto. The baseboard plate 40 comprises an ovular vertical surface envisioned to be affixed thereto the height adjustment plate 30 preferably using a welding process; however, the baseboard plate 40 may be integral thereto said height adjustment plate 30 or affixed thereto using screws, rivets, or the like with equal benefit. The height adjustment plate 30 and the baseboard plate 40 comprise a vertically adjustable assembly providing a vertically adjustable means thereto a pair of cutting blades 100. The cutting blades 100 are affixed thereto a top surface of the height adjustment plate 30 along a forward edge using a pair of integral blade retaining studs 34 and blade retaining nuts 35. The height adjustment plate 30 is envisioned to provide expected blade securing features such as recessed areas, cutouts, retaining plates, and the like to properly position and expose the cutting blade edges 100. The cutting blades 100 are envisioned to comprise standard trapezoidal refill blades common in the industry. The height adjustment plate 30 further comprises a first guidepost 21, a second guidepost 25, a pair of compression springs 22, an adjuster bolt 23, and a thumbnut 24. The height adjustment plate 30 is held firmly at a user selectable height by a spring force applied to a bottom surface thereby the compression springs 22 which press and hold said plate 30 up against the thumbnut 24 being threadingly attached thereto a centrally located adjuster bolt 23 being threadingly affixed thereto the base 20. The thumbnut 24 is envisioned to comprise a common two (2) or three (3) ear plastic fastener providing easy manual adjustment. Additionally, the compression springs 22 are aligned and circumscribed around a first guidepost 21 and a second guidepost 25 which provide additional lateral stability thereto the height adjustment plate 30 during use. Said guideposts 21, 25 comprise custom flat-head fasteners being threadingly affixed thereto the base 20 along a bottom surface thereof and comprising straight sides which extend upwardly therethrough said compression springs 22 and continue upwardly being slidingly inserted therethrough the height adjustment plate 30 via a pair of guidepost apertures 37. The guidepost apertures 37 are located at outer positions along a rear edge of said height adjustment plate 30 and comprise drilled holes specifically sized so as to fit snuggly over the guideposts 21, 25.

The baseboard plate 40 further comprises a pair of rollers 41, a pair of axles 42, and a pair of roller apertures 43. The baseboard plate 40 comprises an elongated oval shaped plate approximately six (6) to eight (8) inches wide and one-eighth (⅛) inch thick, extending horizontally, parallel to, and slightly forward thereof, the front edge of the base portion 20. The baseboard plate 40 provides a positioning means thereto a pair of vertical plastic rollers 41 being affixed thereto said baseboard plate 40 at opposing leading and trailing ends thereof via fixed vertical axles 42. The rollers 41 provide a smooth lateral motion of the device 10 when pressed against a baseboard while coincidentally maintaining a constant distance therefrom said baseboard during a carpet trimming task. The rollers 41 are envisioned to be made of a durable plastic material such as nylon, urethane, or the like being approximately three-eighths (⅜) inch in diameter and one-half (½) inch in height. Said rollers 41 are mounted in line therewith and internal thereto the baseboard plate 40 via a pair of rectangular roller apertures 43. The roller apertures 43 enable a small portion of said rollers 41 to protrude beyond a forward surface of the baseboard plate 40. The roller axles 42 are envisioned to comprise steel pins approximately one-sixteenth (1/16) to one-eighth (⅛) inch in diameter being preferably press-fitted therein vertically drilled holes along upper and lower surfaces of the baseboard plate 40 and positioned centrally within the roller apertures 43; however, said roller axles 42 may be attached thereto said baseboard plate 40 using threaded portions with equal benefit.

The handle 50 provides an ergonomic grasping appendage comprising a looping shape having a generally round cross-section approximately one-and-a-half (1½) inches in diameter. The handle 50 provides an attachment thereto the base 20 via a plurality of handle fasteners 51. The handle 50 is envisioned to protrude upward therefrom the base 20 approximately two (2) inches before angling towards a rear portion of the device 10 at approximately twenty degrees (20°) from a vertical plane. The handle 50 allows a user to exert a steady downward and forward force during use. The handle 50 is envisioned to be made using sturdy materials such as aluminum, wood, plastic, or the like and may be provided with a compliant high-friction coating of rubber or plastic to improve a user's grip and reduce skin fatigue during periods of extended use of the device 10. It is understood that a person skilled in the art will appreciate that many other ergonomically sound designs of the handle 50 based upon a user's preference are possible without deviating from the basic concept and as such should not be interpreted as a limiting factor of the present invention 10.

Referring now to FIG. 3, a bottom perspective view of the device 10, according to the preferred embodiment of the present invention, is disclosed. The device 10 comprises a base 20, a plurality of pivot bracket fasteners 27, a pair of handle fasteners 51, an adjuster bolt 23, a first guidepost 21, a second guidepost 25, a sliding surface 28, and a tucker 29. The base 20 provides a flat bottom surface thereto the device 10 as it slides along a carpet surface. The base 20 comprises a number of fasteners and attachment components providing an attachment means thereto top mounted elements. Said fasteners and attachment hardware listed above, comprise flat-head designs so as to maintain said flat bottom surface of said base 20. The adjuster bolt 23, the first 21 and second 25 guideposts comprise an attachment means thereto the base 20 via a male threaded length thereof being threadingly engaged thereto mating female threaded portions therein the base 20. The pivot bracket fasteners 27 and handle fasteners 51 utilize a plurality of drill holes therethrough said base 20 and female threaded regions provided therein the aforementioned pivot brackets 26 and handle 50. The base 20 further comprises an integral tucker appendage 29 located at an intermediate position along a front edge. The tucker appendage 29 protrudes outward and slightly downward therefrom the base 20 approximately one (1) inch. The tucker appendage 29 provides a directional and downward force thereto a trimmed carpet edge, thereby automatically performing an additional task by propelling said carpet edge under a lower edge of a baseboard during use.

The base 20 further comprises a sliding surface 28 affixed thereupon an entire bottom surface thereof (shown here partially detached therefrom the base 20 for illustration sake). The sliding surface 28 is envisioned to be attached thereto the base 20 using a variety of adhesives, epoxies, or the like in an expected manner. The sliding surface 28 is further envisioned to comprise a low-friction material such as Teflon®, fiberglass, nylon, high-durometer urethane, or the like allowing the device 10 to slide smoothly across a carpet during trimming.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the device 10 may be achieved by performing the following steps: installing a pair of cutting blades 100 using the blade retaining studs 34 and nuts 35; adjusting the height adjustment plate 30 using the adjuster nut 24 thereto a vertical position which corresponds to a particular carpet thickness producing a correct cut length thereof; positioning the device 10 by sliding the base 20 across a carpet area using the low-friction sliding surface 28; holding the device 10 securely against a baseboard by grasping and manipulating the device using the handle 50; feeding a carpet end portion into a cutting blade area 100 to begin a trimming step; performing a left-to-right or right-to-left cutting motion along a carpet surface using the two (2) opposing cutting blades 100, respectively; manipulating the device 10 along a baseboard surface by contacting said baseboard therewith the rollers 41 providing a smooth sliding motion without damaging or marking said baseboards; completing a wall-to-wall carpet installation by performing any number of trimming cuts required based upon specific requirements of a project; storing the device 10 until needed again; and, benefiting from improved adjustability, ergonomics, and baseboard appearance afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An adjustable carpet trimming device for cutting excess carpet portions along an existing baseboard during carpet installation procedures, said carpet trimming device comprising:

a base having top and bottom surfaces;

a tucker appendage located at an intermediate position along said front edge of said base, said tucker appendage protruding outwardly from said base for providing a downward force to the excess carpet portions and thereby propelling an edge of the excess carpet portions under said bottom surface of said base;

a height adjustment plate positioned above said base and having first and second arms extending proximally above said base;

a baseboard plate conjoined to a forward edge of said height adjustment plate and being registered orthogonal thereto;

a plurality of axles attached to said baseboard plate and a plurality of rollers rotatably positioned thereabout, said rollers extending forwardly of a forward face of said baseboard plate and adapted to engage said existing baseboard during cutting operations;

means for cutting the excess carpet portions, said cutting means being coupled to said height adjustment and baseboard plates respectively; and, a handle statically attached to said base and extending upwardly therefrom, said handle being intermediately seated between said first and second arms of said height adjustment plate;

wherein said trimming device further comprises an adjustment means for selectively adjusting a vertical height of said height adjustment plate between raised and lowered positions such that said cutting means is positioned along the excess carpet portions;

wherein a bottom edge of said height adjustment plate is situated above said top surface of said base when said height adjustment plate is disposed at a lowest-most position.

2. The carpet trimming device of claim 1, wherein said adjustment means further comprises:

a pair of pivot brackets affixed to said base;

an elongated and rectilinear pivot bolt;

a pivot nut adjustably conjoined to one end of said pivot bolt; and, a plurality of guidepost apertures formed within said first and second arms respectively;

wherein said pivot bolt has axially opposed ends positioned through said pair of pivot brackets.

3. The carpet trimming device of claim 2, wherein said cutting means comprises:

a plurality of cutting blades attached to said height adjustment plate and said baseboard plate respectively, said cutting blades being located adjacent to right and left outer arcuate edges of said height adjustment plate, each of said cutting blades having a cutting surface facing outwardly and away from a center of said height adjustment plate to thereby trim the excess carpet portions along a bi-directional manner; and, a plurality fasteners adjustably mated to said cutting blades and said height adjustment plate respectively.

4. The carpet trimming device of claim 2, wherein said first and second arms are pivotally attached to said pivot brackets respectively;

wherein said height adjustment plate is provided with a plurality of apertures formed therein;

wherein said forward edge of said height adjustment plate extends upwardly and away from a corresponding front edge of said base.

5. The carpet trimming device of claim 4, wherein said adjustment means further comprises:

first and second guideposts vertically extending upward from said base and passing through said height adjustment plate apertures respectively;

a plurality of compression springs positioned about said first and second guideposts and intercalated between said height adjustment plate and said base respectively; and, a fastener attached to said height adjustment plate for maintaining a fixed spatial distance between said base and said height adjustment plate during cutting operations.

6. The carpet trimming device of claim 1, wherein each of said rollers is independently rotatable along a mutually exclusive axis registered orthogonal to said base.

7. An adjustable carpet trimming device for cutting excess carpet portions along an existing baseboard during carpet installation procedures, said carpet trimming device comprising:

a base having planar top and bottom surfaces;

a tucker appendage located at an intermediate position along said front edge of said base, said tucker appendage protruding outwardly from said base for providing a downward force to the excess carpet portions and thereby propelling an edge of the excess carpet portions under said bottom surface of said base;

a height adjustment plate positioned above said base and further having parallel disposed first and second arms extending proximally above said base;

a baseboard plate statically conjoined to a forward edge of said height adjustment plate and being registered orthogonal thereto;

a plurality of axles attached to said baseboard plate and a plurality of rollers rotatably positioned thereabout, said rollers extending forwardly of a forward face of said baseboard plate and adapted to engage said existing during cutting operations;

means for cutting the excess carpet portions, said cutting means being coupled to said height adjustment and baseboard plates respectively; and, a handle statically attached to said base and extending upwardly therefrom, said handle being intermediately seated between said first and second arms of said height adjustment plate;

wherein said trimming device further comprises an adjustment means for selectively adjusting a vertical height of said height adjustment plate between raised and lowered positions such that said cutting means is positioned along the excess carpet portions;

wherein a bottom edge of said height adjustment plate is situated above said top surface of said base when said height adjustment plate is disposed at a lowest-most position.

8. The carpet trimming device of claim 7, wherein said adjustment means further comprises:

a pair of pivot brackets affixed to said base;

an elongated and rectilinear pivot bolt;

a pivot nut adjustably conjoined to one end of said pivot bolt; and, a plurality of guidepost apertures formed within said first and second arms respectively;

wherein said pivot bolt has axially opposed ends positioned through said pair of pivot brackets.

9. The carpet trimming device of claim 8, wherein said cutting means comprises:

a plurality of cutting blades attached to said height adjustment plate and said baseboard plate respectively, said cutting blades being located adjacent to right and left outer arcuate edges of said height adjustment plate, each of said cutting blades having a cutting surface facing outwardly and away from a center of said height adjustment plate to thereby trim the excess carpet portions along a bi-directional manner; and, a plurality fasteners adjustably mated to said cutting blades and said height adjustment plate respectively.

10. The carpet trimming device of claim 8, wherein said first and second arms are pivotally attached to said pivot brackets respectively;

wherein said height adjustment plate is provided with a plurality of apertures formed therein;

wherein said forward edge of said height adjustment plate extends upwardly and away from a corresponding front edge of said base.

11. The carpet trimming device of claim 10, wherein said adjustment means further comprises:

first and second guideposts vertically extending upward from said base and passing through said height adjustment plate apertures respectively;

a plurality of compression springs positioned about said first and second guideposts and intercalated between said height adjustment plate and said base respectively; and, a fastener attached to said height adjustment plate for maintaining a fixed spatial distance between said base and said height adjustment plate during cutting operations.

12. The carpet trimming device of claim 7, wherein each of said rollers is independently rotatable along a mutually exclusive axis registered orthogonal to said base.

* * * * *